United States Patent [19]

Schwalbe et al.

[11] Patent Number: 4,825,734

[45] Date of Patent: May 2, 1989

[54] VARIABLE LEVERAGE TOOL HANDLE

[75] Inventors: Peter K. Schwalbe; George R. Slivon, both of Kenosha, Wis.

[73] Assignee: Snap-on Tools Corporation, Kenosha, Wis.

[21] Appl. No.: 144,050

[22] Filed: Jan. 15, 1988

[51] Int. Cl.[4] ..... B25B 23/16

[52] U.S. Cl. ..... 81/177.9; 81/177.7

[58] Field of Search ..... 81/177.7, 177.8, 177.9

[56] References Cited

U.S. PATENT DOCUMENTS

| | | | |
|---|---|---|---|
| 839,477 | 12/1906 | Heller . | |
| 2,068,207 | 1/1937 | Toribert | 81/177.7 |
| 2,182,673 | 12/1939 | Magnano | 81/177.7 |
| 2,572,444 | 10/1951 | Carden | 81/177.8 |
| 2,635,660 | 4/1953 | Dawson . | |
| 3,773,094 | 11/1973 | Kuenzel . | |
| 3,797,546 | 3/1974 | McGee . | |
| 4,000,767 | 1/1977 | Geng . | |
| 4,542,667 | 9/1985 | Jang . | |

FOREIGN PATENT DOCUMENTS

| | | | |
|---|---|---|---|
| 0487053 | 3/1975 | Australia | 81/177.9 |
| 2715379 | 10/1979 | Fed. Rep. of Germany | 81/177.9 |

*Primary Examiner*—Frederick R. Schmidt
*Assistant Examiner*—Blynn Shideler
*Attorney, Agent, or Firm*—Emrich & Dithmar

[57] ABSTRACT

A variable leverage tool handle comprises a handle having first and second elongated parts and a pivotal tongue and clevis joint therebetween, accommodating movement approximately 90° in opposite directions from a normal in-line configuration. The joint includes a detent pin resiliently biased against the tongue for engagement with at least one pin-receiving depression thereon resiliently retaining the first and second handle parts in their normal in-line configuration.

6 Claims, 2 Drawing Sheets

VARIABLE LEVERAGE TOOL HANDLE

BACKGROUND OF THE INVENTION

This invention relates to a tool handle used in conjunction with a variety of elongated shanks and appropriate tips thereon for driving screws, or other fasteners and the like. Optimally, such handles convert the twisting force and forward pressure of the operator's hand into a rotational and axial motion of the shank with sufficient torque and axial thrust to drive the fastener. The handle should also be sufficiently maneuverable to facilitate accurate mating of the fastener and the tip, and to afford sufficient smoothness of twisting to permit numerous quick rotations at low torque when required.

Often, to achieve the high torque required for the final tightening or initial loosening of a fastener, designers have provided the tool handle with deep grooves or knurling to prevent slippage of the user's hand over the handle. Others have added wings that flip out, sheaths which fold up, handles which convert into "T-shaped" configurations, and handles which convert into "L-shaped" configurations in order to provide additional leverage to achieve the desired torque. These methods have their drawbacks. The deep grooves can only supply limited additional torque before becoming physically uncomfortable to the user. Winged, "T" or "L" designs often require the use of a second hand to convert to the high-leverage configuration. This impairs the utility of the tool in close quarters, such as when the fastener is being driven parallel to a closely adjacent surface. Some latch-release "L" designs can be converted by a single hand, but the latch release operation prevents smooth shifting between high and low leverage configurations. Winged or "T" designs require additional clearance space for the extended portions on opposite sides of the handle.

Often, such handle constructions cannot be used in the palm of a single hand because the awkward position of the hand during use makes it hard to align the shank tip with the mating part of the fastener. It is often desirable to use a driver in both conventional and high-leverage positions while driving a single fastener. The time wasted in converting the wrench during the middle of the driving operation is very costly, often resulting in the user utilizing the tool in just one position all the time and/or using two hands rather than one.

SUMMARY OF THE INVENTION

It is therefore an important object of the present invention to provide a variable leverage tool handle whic is of simple and economical manufacture.

Another object is to provide a variable leverage tool handle in which the conversion among different leverage positions is easily performed by the user during operation.

It is another object to provide a tool handle that, when combined with a flat-blade shank tip, provides an instinctive feel for the orientation of the tip relative to the handle without visual feedback being required.

Still another object is to provide a tool with a comfortable handle that is both easy to twirl in lowtorque applications as well as comfortable to operate in its higher-torque applications.

Yet another object is to provide a tool handle with continuous adjustment throughout a range of leverage configurations to meet the varying needs of each use.

Another object is to provide a tool handle that can be smoothly converted among various leverage configurations while in a single hand, without the need of an additional hand to achieve the conversion.

It is another object to provide a tool handle that can be utilized to afford increased leverage, even in places where room for the maximum leverage positioning does not exist.

Certain of these features are attained by providing a variable leverage handle structure for manually rotating a tool shank about its longitudinal axis, the structure comprising: an elongated first handle part fixedly secured to one end of the shank, a second elongated handle part, and means coupling the first handle part to the second handle part at the distal end thereof for movement with respect thereto between first and second positions, the second handle part in the first position thereof being disposed substantially coaxial with said first handle part, the second handle part in the second position thereof being inclined with respect to the first handle part for cooperation therewith to form a high leverage tool handle.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
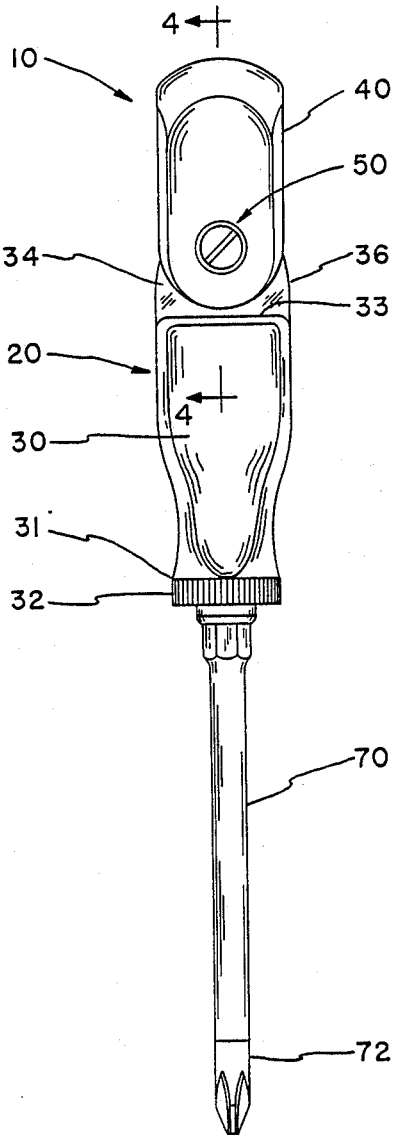
FIG. 1 is an elevation view of a screwdriver with a handle structure incorporating the features of the present invention.

Referring to FIGS. 1–4, shown is a screwdriver 10, including a variable leverage tool handle 20 having an elongated first handle part 30 and an elongated second handle part 40 interconnected by a pivot joint 50. A shank 70 is shown fixedly secured to the first handle part 30.

The first handle part 30 has a cylindrical end 31 with knurls 32 extending circumferentially therearound. The other end of the handle part 30 is relieved to form two shoulders 33 and an axially projecting tonque portion 34. The tongue portion 34 has flat, substantially parallel, opposed side surfaces 35 which respectively intersect the shoulders 33 at right angles thereto. The side surfaces 35 are interconnected by and are substantially normal to a part cylindrical peripheral surface 36 which is continuous with the outer surface of the first handle part 30. The tongue portion 34 has a hole 37 extending between the side surfaces 35 which freely slidably receives coaxially therein an internally threaded sleeve 38 for cooperation with the pivot joint assembly 50, as will be explained below. The peripheral surface 36 has a detent recess 39 therein substantially centrally thereof for a purpose to be explained below.

The second handle part 40 has a body 42 with a rounded end surface 43 and a pair of clevis legs 44 which cooperate with the tongue portion 34. The legs 44 respectively have coaxial bores 45 therethrough countersunk at the outer ends thereof.

In assembly, the tongue portion 34 is received between the clevis legs 44 with the bores 45 aligned with the hole 37 for receiving screws 52 in threaded engagement to form the pivot joint 50. The second handle part 40 also contains a body bore 46 positioned between its clevis legs 44. Snugly disposed in the body bore 46 is a cylindrical sleeve 48 for receiving coaxially therein a helical compression spring 55 and a detent pin 60 having a rounded end 62 which is dimensioned for cooperation with the recess 39. The pin 60 is urged outwardly of the bore 46 by the spring 55 toward engagement with the peripheral surface 36 of the tongue portion 34.

The second handle part 40 is pivotally movable about the axis of the sleeve 38, the movement being limited by engagement of the body 42 with the shoulders 33 when the second handle part 40 is positioned with the longitudinal axis thereof generally normal to the longitudinal axis of the first handle part 30.

The shank 70 is fixedly secured to the cylindrical end 31 of the handle part 30 and projects axially therefrom. The shank 70 carries a tip 72 at its distal end. While the tip 72 is shown as a Phillips head screw driving tip, it will be appreciated that many other types of tips could be used.

Referring now to FIGS. 5–8, the operation of the tool handle 20 will be described. The rounded outer surfaces of handle parts 30 and 40 glide smoothly within the user's palm. The angular shape of handle parts 30 and 40, which are generally square in transverse cross section, provides an intermediate range of torque when the knurls 32 don't provide enough grip, yet when the added leverage of the second handle part 40 is not yet necessary to drive the fastener (see FIG. 8). The knurls 32 allow the user's fingertips (see FIG. 8) to smoothly and quickly twirl the tool when numerous low torque rotations of the screw/fastener are desired, e.g. when initially driving a screw, or after it has been loosened. When a flat bladed tip 72*f* is utilized (see FIG. 7), the tool handle 20 provides an instinctive feel for the orientation of the tip relative to the second handle part 40 without visual feedback being required, since the user can determine the plane of pivoting from the feel of the handle and relate that to the relative plane in which the blade tip 72*f* resides.

Figure 2:
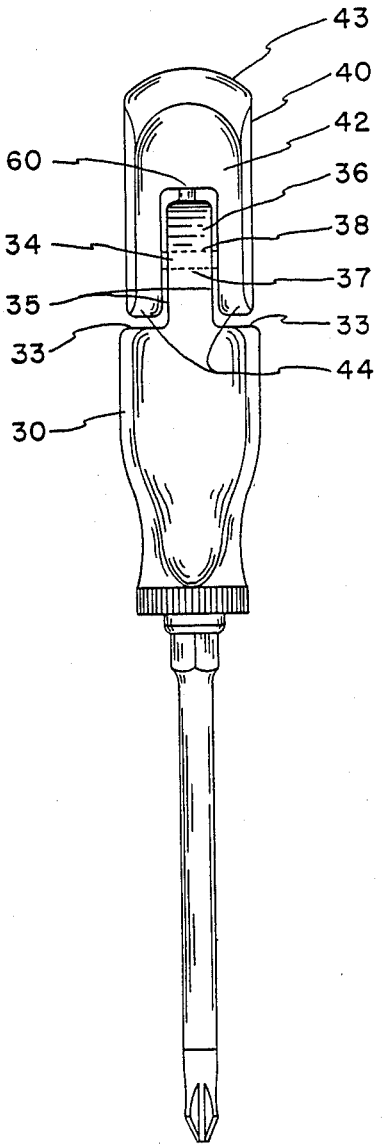
FIG. 2 is an elevation view of the screwdriver of FIG. 1, rotated 90° about the axis of the shank.
Figure 3:
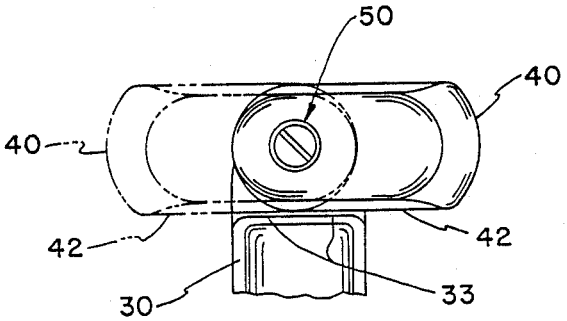
FIG. 3 is a fragmentary view of the handle structure of the screwdriver of FIG. 1, shown in two of its potential high leverage configurations.
Figure 4:
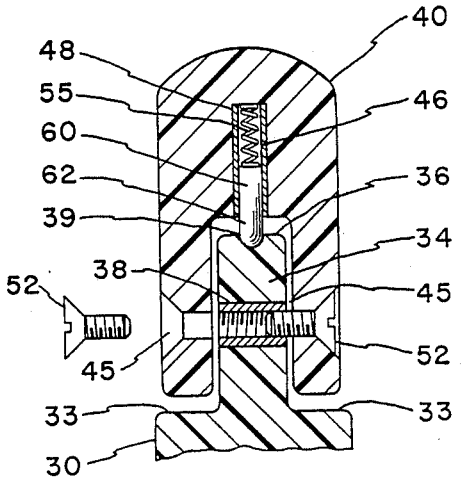
FIG. 4 is an enlarged fragmentary view in section of the handle structure of the screwdriver of FIG. 1, taken along the line 4—4 therein, with one of the pivot screws shown detached.
Figure 5:
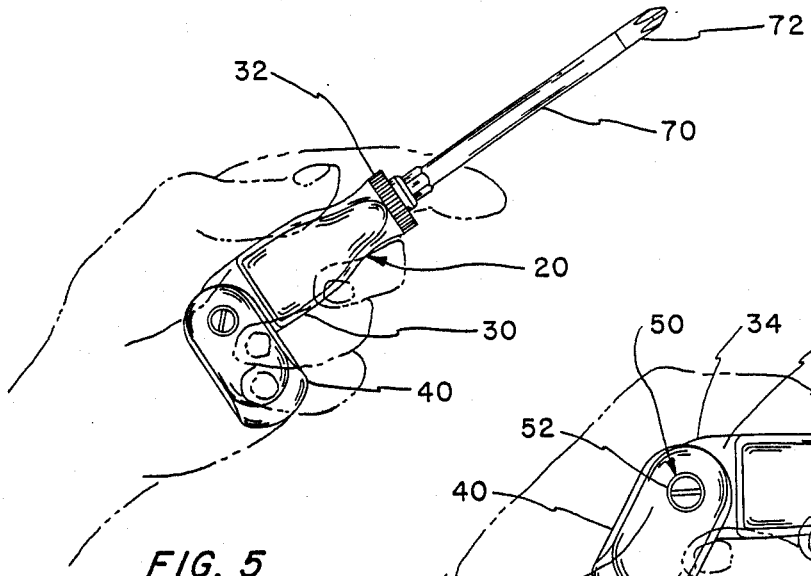
FIGS. 5–8 are perspective views of various configurations of the handle structure in the hand of a user.
Figure 6:
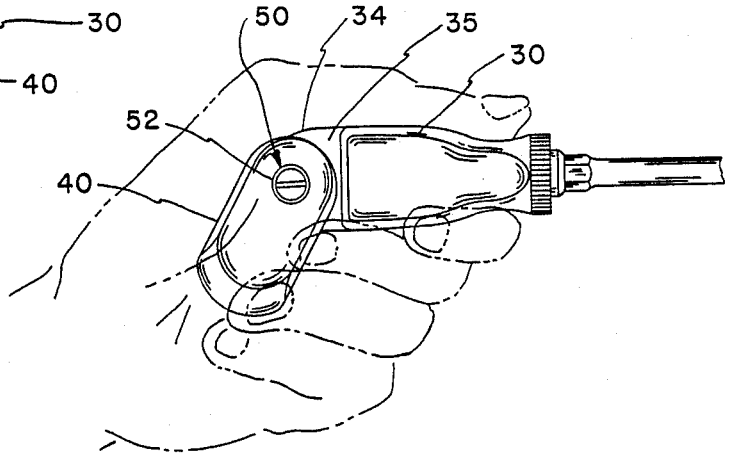
Figure 7:
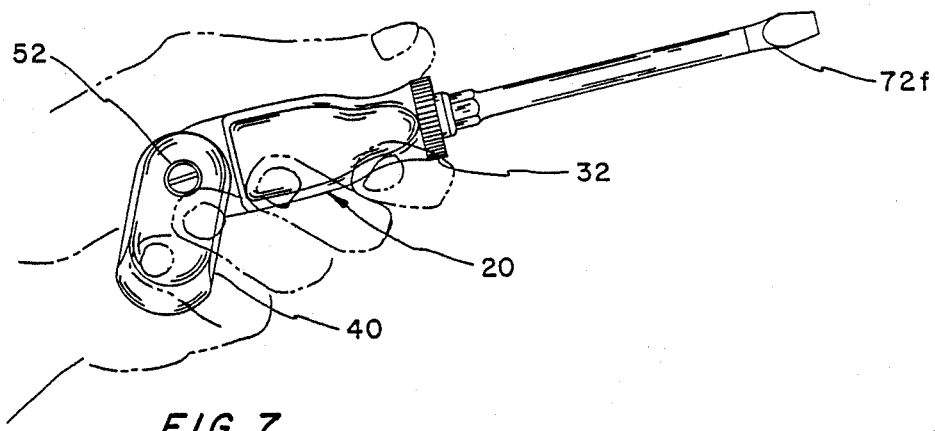
Figure 8:
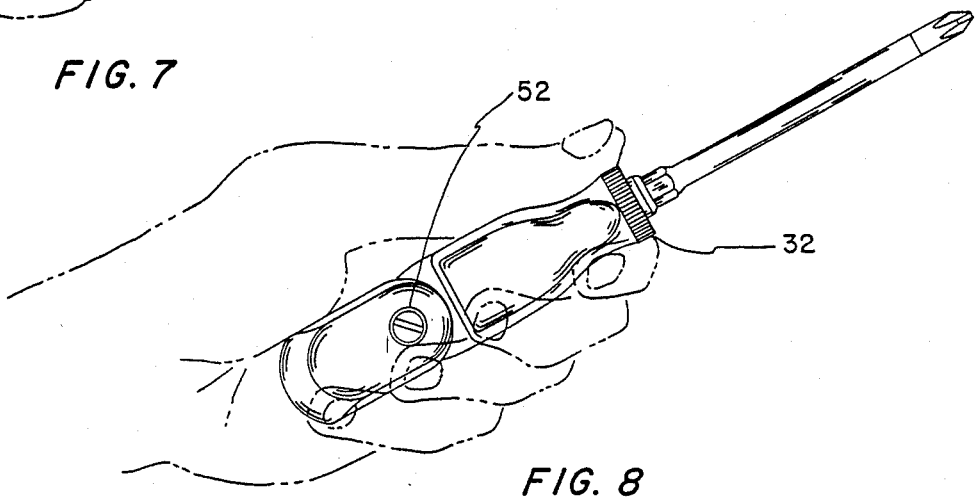

The peripheral surface 36 of the torque portion 34 has a width slightly less than the distance between the clevis legs 44 (see FIG. 2). The parts are arranged and dimensioned so that, when assembled, the peripheral surface 36 clears the surface of the body 42 located between the clevis legs 44 so as to allow the second handle part 40 to pivot freely over the tongue portion 34 of the first handle part 30 (see FIGS. 5–6). The pivot joint 50 allows the second handle part 40 to pivot over a continuous range, as illustrated in FIGS. 3, 5, 6 and 7, among various configurations which provide added leverage in a continuous range from minimum to maximum added leverage. The maximum amount of leverage is achieved when the second handle part 40 is positioned substantially normal to the first handle part 30 (see FIG. 3). The quantitative amount of maximum leverage is limited by the length of the second handle part 40, which is limited to that length which can be comfortably maneuvered between various leverage positions within the palm of the user's hand (see FIGS. 5–8).

It is significant that the user can initiate the driving process with the handle parts 30 and 40 in a first, coaxial configuration (see FIG. 8), shift to one of many higher leverage positions (see FIGS. 5 and 6) with that same hand while still engaging the fastener with the shank tip 72, rotate the shank 70 approximately 180°, pivot the handle part 40 180° back through its standard, coaxial position (see FIG. 8) and one of its opposite higher leverage positions, (not shown) all within and with the same hand, while continuously engaging the fastener. The process may be repeated until the need for higher leverage is alleviated. When the handle 20 is disposed in its aligned, low leverage configuration illustrated in FIG. 8, the spring 55 biases the pin 60 into engagement with the detent recess 39 to resiliently hold the handle 20 in that configuration. The sleeve 38 pivots freely within the hole 37, so that the screws 52 and the sleeve 38 pivot with the second handle part 40, not moving independently thereof (compare alignment of part 52 in FIGS. 5–8).

In summary, there has been provided a tool handle 10 that can be smoothly converted among various leverage configurations while in a single hand, without the need for an additional hand to achieve the conversion (see FIGS. 5–8) by maintaining an aligned configuration when desired, yet allowing easy conversion to any number of variable leverage positions with just the flick of the user's palm against the second handle part 40 while steadying the first handle part 30 with his fingertips.

While there has been described what is, at present, considered to be the preferred embodiment, it is to be understood that various modifications can be made without departing from the spirit or scope of this invention as defined in the claims appended hereto.

We claim:

1. A variable leverage handle structure for accommodating manual rotation of a tool shank about its longitudinal axis in both conventional and high leverage configurations by a single hand of a user, said structure comprising: an elongated first handle part having a shank end fixedly secured to one end of the shank coaxially therewith and a pivot end, a second elongated handle part having a pivot end and a distal end, means coupling said pivot end of said first handle part to said pivot end of said second handle part for relative pivotal movement about a pivot axis among first and second and third positions with said first position being disposed intermediate said second and third positions, said second handle part having a length from the distal end theroef to said pivot axis substantially less than the length of said first handle part from said pivot axis to the shank, said second handle part in the first position being disposed substantially coaxial with said first handle part, said second handle part in the second and third positions being inclined with respect to said first handle part for cooperation therewith to form a high leverage tool handle, said coupling means including a tongue protruding from said first handle part and shoulders projecting laterally from said tongue and clevis legs on said second handle part engageable with said shoulders to arrest the movement of said second handle part in said second and third positions, and detent means resiliently holding said second handle part in at least said first position thereof, said pivot axis being disposed closely adjacent to said pivot ends of said first and second handle parts so that neither pivot end projects laterally beyond the other in any position thereof, whereby said handle structure is enclosable within one hand of an ordinary user in all positions thereof.

2. The handle structure of claim 1, wherein the length of said second handle part is approximately one-half the length of said first handle part.

3. The handle structure of claim 1, wherein said coupling means includes camming detent means for resiliently retaining said handle parts in each position thereof, while accommodating movement therefrom by simple pressure of the user's one hand.

4. The handle structure of claim 1, wherein said first handle part has a cylindrical portion adjacent to the associated shank and provided with a frictional gripping surface.

5. The handle structure of claim 1, wherein said second handle part in said second and third positions is disposed with the longitudinal axis thereof substantially normal to that of said first handle part.

6. The handle structure of claim 1, wherein said first handle part has a cylindrical knurled portion adjacent to the associated shank.

* * * * *